United States Patent [19]

Santagiuliana

[11] Patent Number: 5,054,662

[45] Date of Patent: Oct. 8, 1991

[54] CAP WITH A DISPENSER FOR LIQUIDS

[75] Inventor: Evans Santagiuliana, Vicenza, Italy

[73] Assignee: Taplast SNC di Evans Santagiuliana & C., Vicenza, Italy

[21] Appl. No.: 479,413

[22] Filed: Feb. 13, 1990

[30] Foreign Application Priority Data

Mar. 7, 1989 [IT] Italy ..... 85542 A/89

[51] Int. Cl.[5] ..... B67D 3/00

[52] U.S. Cl. ..... 222/531; 222/534; 222/556

[58] Field of Search ..... 222/531, 534, 545, 556, 222/558

[56] References Cited

U.S. PATENT DOCUMENTS

| | | | |
|---|---|---|---|
| 2,990,980 | 7/1961 | Gronemeyer | 222/556 |
| 3,542,256 | 11/1970 | Waterman | 222/534 |
| 3,734,359 | 5/1973 | Waterman | 222/534 |

FOREIGN PATENT DOCUMENTS

| | | |
|---|---|---|
| 0176108 | 4/1986 | European Pat. Off. . |
| 2644758 | 9/1977 | Fed. Rep. of Germany . |
| 8105763 | 7/1983 | Netherlands . |

OTHER PUBLICATIONS

European Search Report.

*Primary Examiner*—Michael S. Huppert
*Assistant Examiner*—Anthoula Pomrening

[57] ABSTRACT

The invention discloses a cap made of plastic material for containers holding liquids, which includes an essentially cylindrical main body and an element for dispensing the liquid. The dispensing element has an essentially round, flat upper part, hinged into the main body and a lower part in the shape of a socle having a partially cylindrical base surface which slides on a corresponding concave surface belonging to a main body. The contact between the cylindrical surface of the base and the concave surface of the main body insures the tightness. Moreover, around the opening of the concave surface of the cylindrical body there is a ring-shaped projection acting as a seal when the dispenser is in its open position. When the dispenser is closed, the ring-shaped projection matches a corresponding round indentation which is found in the base, so as to insure the tightness between the dispenser and the body of the cap, regardless of the position of the container.

4 Claims, 2 Drawing Sheets

CAP WITH A DISPENSER FOR LIQUIDS

BACKGROUND OF THE INVENTION

1. Field of the Invention

The invention concerns a cap with a dispenser particularly suited to be used on bottles or flagons containing liquids, for instance, cosmetics, liquid soaps, shampoos, sun lotions and the like.

The indication of its use is given as an example only but is not meant to limit the field of application of the cap according to the invention.

2. Description of Related Arts

Caps for containers of liquid cosmetics, such as shampoos or lotions are available on the market. Their mode of operation consists essentially in the fact that the cap comprises a dispenser for liquids which can be operated by the user. One of the known caps, for instance, has at the upper end of the cap itself a plastic hollow insert, which is hinged around a horizontal axis and can rotate from a horizontal to a vertical position, so that, when the insert is in its horizontal position, the liquid is prevented from pouring out of the bottle, while, when the insert is set in its vertical position, the opening which is present at the bottom of the cap and in contact with the neck of the bottle is aligned with the channel of the vertical insert, thereby allowing the liquid to flow out of the bottle. Since the bottom of this insert has a cylindrical shape and the bottom rotates on a surface which is also cylindrical, wherein there is the opening for the outflow of the liquid, this type of cap does not present any special problem connected with the leakage of the liquid, when the cap is in its closed position. However limitations of the just described cap consist in that the opening and closing operations must be performed by the operator with both hands, i.e. with one holding the bottle and with the other operating the rotation of the insert.

Another type of cap which is used in the same field of cosmetic products presents an essentially cylindrical body with a vertical opening and an upper element having essentially the shape of a disc presenting underneath a little hollow tube for the outflow of the liquid. The upper element engages the cylindrical body, is hinged to it and can rotate by a certain angle when it is pressed with the finger tips. When the upper element is in its horizontal position, it shuts the hollow tube belonging to the central body, through which the liquid would flow out; on the other hand, when the upper element is pushed with a finger and arranges itself at an inclined position, the tube belonging to the central body and the channel which is present on the rotating element are aligned. While this cap presents the advantage that it can be opened and closed with a single hand holding the flagon or the bottle, it has the limitation of not being suited for dispensing very fluid liquids, since its seal is rather precarious, so that the liquid may pour out even when the cap is in its closed position or the liquid besides pouring out of the channel also leaks through the space between the rim of the cap body and the rotating element.

The main purpose of the present invention is to overcome the mentioned inconveniences.

The main proposed purpose is to realize a cap with a dispenser for liquids which is perfectly sealed, regardless of the density of the liquid to be dispensed and which can be operated with the same hand holding the bottle.

Another proposed purpose is to obtain a cap with a dispenser being shaped so as to compensate for possible variations of the thickness of the bottle neck, so that a perfect seal is obtained between the cap and the rim of the bottle neck.

All above-mentioned purposes and others, which will be better understood hereafter are fulfilled by a cap for liquids, made of plastic material, comprising a main, essentially cylindrical body which tightens on a bottle or flagon and presents an upper surface, which is concave toward the exterior, with an opening communicating with a channel belonging to the liquid-dispensing element, which is connected with said body, so that it can rotate around an axis being perpendicular to the geometrical axis of said body and wherein said cap is characterized in that said element presents an essentially cylindrical, upper, outer, flat part, which is hinged onto the upper rim of the main body and a lower part having the shape of a socle and acting as a base and having its lower surface in a partially cylindrical shape and sliding on the correspondingly shaped concave surface belonging to the main body, wherein said base part presents an opening belonging to a channel whose first section, beginning from said opening, is essentially vertical and whose second section is essentially perpendicular in relation to the first and is obtained underneath the flat surface of the dispensing element, and it ends with an opening on the lateral rim of said element. One of the advantages given by such a shape of the cap is that the hermetic tightness of the connection is always insured both when the dispensing element is in its open, liquid dispensing position and when it is in its closed position.

In the first case the tightness occurs between the opening belonging to the main element, which is present on the concave surface of the main cylindrical body and the opening belonging to the dispensing channel which is connected with the opening.

When the dispensing element is in its closed position, the base belonging to the dispensing element presents, as will be described hereafter, an indentation which lies over the ring-shaped projection which is present around the opening of the concave surface of the main cylindrical body, so that the hermetic tightness is insured in this case, too.

Another advantage obtained with the cap according to the present invention is represented by the fact that the opening and closing operations can be performed with a single finger belonging to the hand holding the container on which the cap is applied, without any need to use the other hand.

This fact is not unimportant since it makes it easier to use the liquid held in the container in the most varied situations, without causing any discomfort to the user.

Another advantage which will be pointed out arises from the fact that the essentially round shape in the convex area of the main cylindrical body which rests on the rim of the container neck allows it to rest on the whole rim of the container, regardless of the variations in the thickness of the container, which are possible particularly in containers made of glass. This permits a wider flexibility of application and a decreased need of observing dimensional tolerances in the manufacture of the container.

BRIEF DESCRIPTION OF THE DRAWINGS

Further scope of applicability of the present invention will become apparent from the detailed description given hereinafter. However, it should be understood that the detailed description and specific example, while indicating a preferred embodiment of the invention, are given by way of illustration only, since various changes and modifications within the spirit and scope of the invention will become apparent to those skilled in the art from this detailed description, and from the drawings, wherein.

DETAILED DESCRIPTION OF PREFERRED EMBODIMENTS

Figure 2:
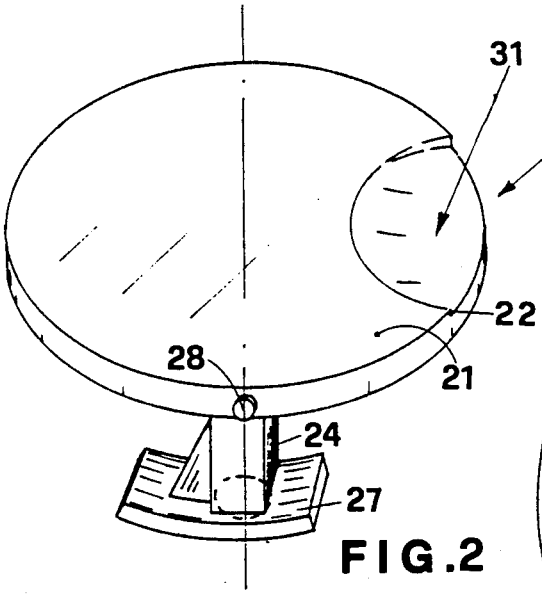
FIG. 2 shows a perspective view of the dispensing element which is connected with the upper part of the cap.
Figure 3:
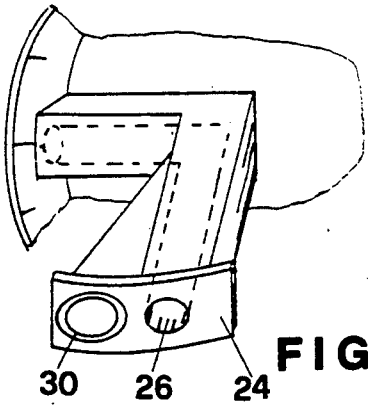
FIG. 3 shows in a perspective view the bottom of the base of the dispensing element.

With reference to the mentioned Figures, it will be observed that the cap according to the invention, indicated as a whole at 10, has an essentially cylindrical body 1 and having two co-axial surfaces, wherein the outer surface is indicated at 2 and the inner, shorter surface is indicated at 3. The inner surface 3 also presents a thread 4 on the side not facing surface 2. The thread 4 is the thread which engages the corresponding thread on container 5, thereby tightening cap 10 on the container. In the upper junction between the cylindrical surface 3 and the cylindrical surface 1 there is a concave junction surface 6, whose concavity, which is turned to the exterior of the cap, is well visible in FIG. 1. The concave surface has an opening 7, arranged essentially in the central position and around its edge there is a ring-shaped projection 8; it will be described hereafter how this ring-shaped projection permits the tightness between the dispensing element and the body 1 of the cap.

Figure 1:
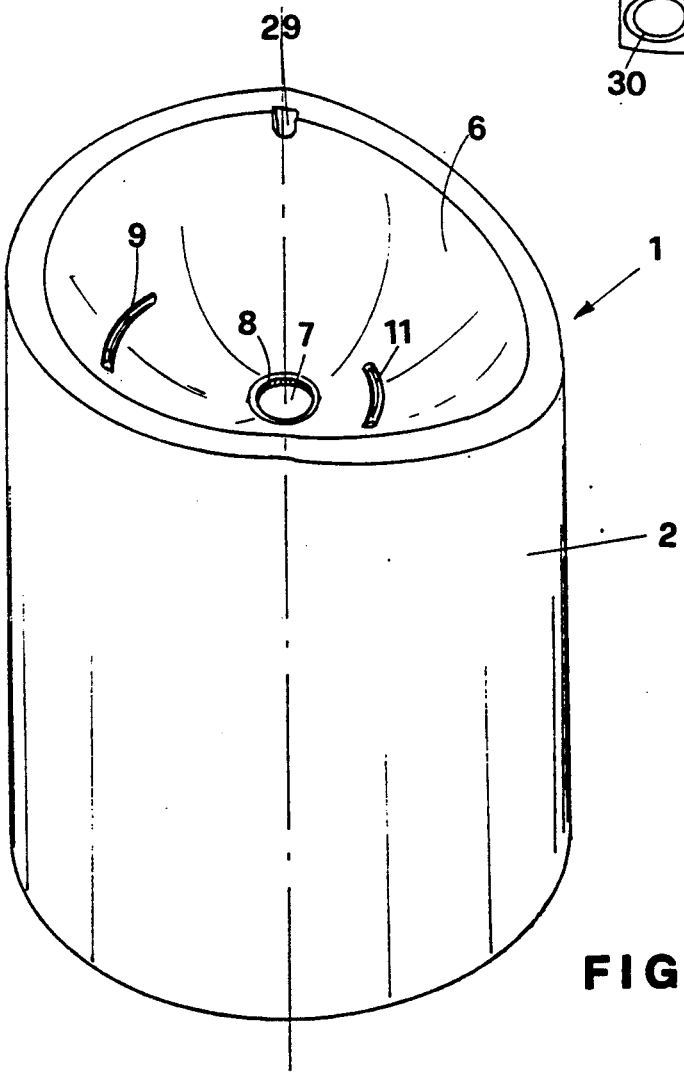
FIG. 1 shows in a perspective view the main body of the cap.

By observing FIG. 1 it will also be noticed that on the concave surface 6 of the main cylindrical body 1 there are two more linear projections indicated at 9 and 11 respectively, arranged at opposite sides in relation to opening 7. As will be seen, The projections are used as stops for the opening and closing movements of the dispensing element connected with the main body 10.

The dispensing element, indicated as a whole at 20, consists of an upper part in the shape of a disc 21, presenting a rim 22 underneath which there is a channel indicated as a whole at 23.

Figure 4:
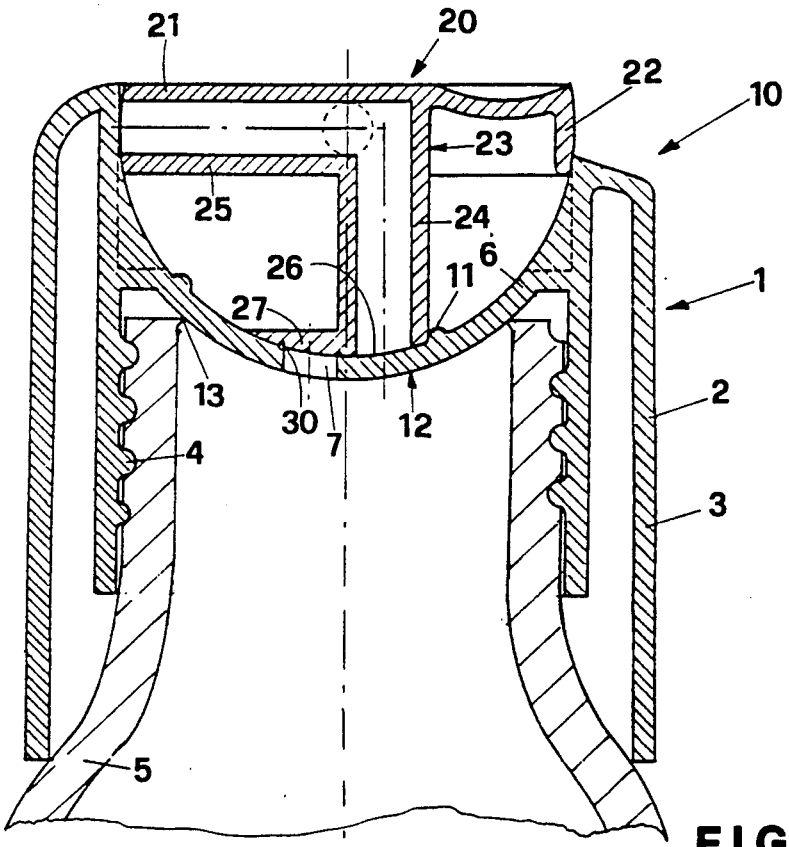
FIG. 4 is a cross-section of the cap as a whole, therefore comprising its main cylindrical body and its dispensing element, wherein the dispensing element is in its closed position.

The channel 23 is essentially in the shape of a right angle and it has a first vertical section 24 and a second section 25 which is tangent to the lower surface of disc 21. The vertical section 24 ends with a hole 26 belonging to the base 27 which has a cylindrical shape with its generating lines which are parallel to the axis of rotation of the dispensing element 20, the axis passing between the two diametrical pivots 28, one of which is represented in FIG. 2. The pivots 28 are lodged within the slits 29 which are present in the lateral rim of the concave surface 6 belonging to the main cylindrical body 1. On the base 27 and on the surface which is in contact with the concave surface 6, next to hole 26 there is a round annular surface 30 which, as can be observed in FIG. 4, when the dispensing element is in its closed position, closes and seals opening 7, since it superimposes itself over the ring-shaped projection S.

Figure 5:
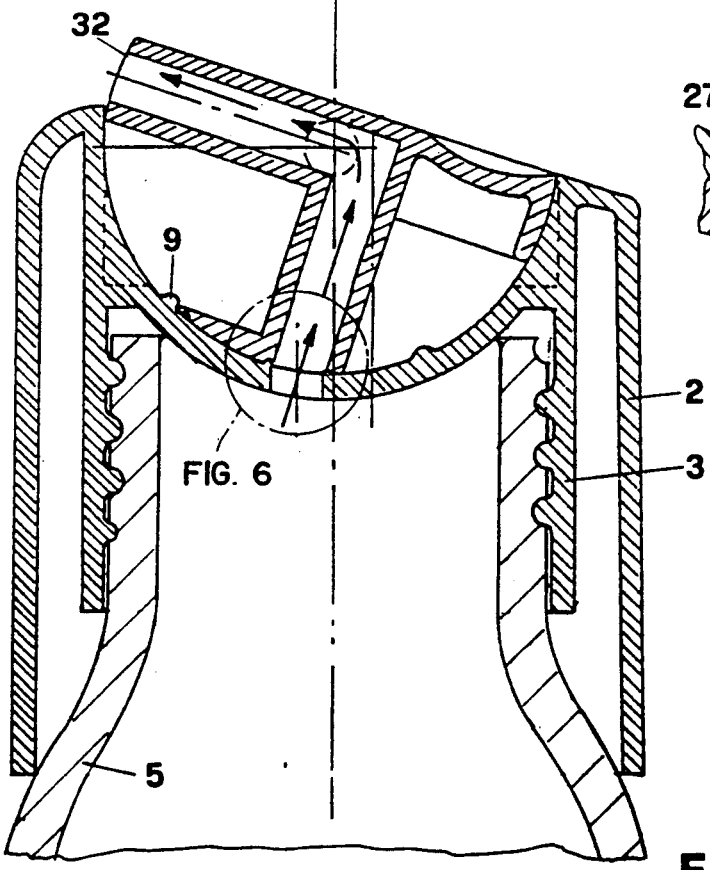
FIG. 5 shows, also in a cross-section view, the cap according to the invention with the dispensing element in its opened position suited for the outpour of the liquid.
Figure 6:
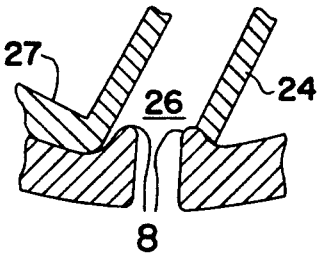
FIG. 6 is an enlarged view of a portion of the dispensing element shown in FIG. 5.

Thus a perfect tightness against the outflow of the liquid held in the bottle or container is insured, said tightness being insured by two simultaneous factors: the first one is the already mentioned one. i.e. the hermetic closing of opening 7, while the second one is represented by the fact that the convex surface 12 opposite to the concave surface 6 rests against the entire rim 13 of container 5 and thereby insures the seal against the outpour of the liquid contained in the bottle regardless of the position of the latter. When an impression 31 of the dispensing element 20 is pressed, the dispensing element is caused to rotate, as can be observed in FIG. 5, and the conveying channel 23 is set into communication with opening 7, so that the liquid contained in bottle 5 can pour out. On this subject it can be observed that the stop 9 insures the correct position of the dispensing element 20 and it also insures that the ring-shaped projection 8 is inserted within the mouth of hole 26 belonging to the channel section 24. Thus, all of the liquid flows out of hole 32 without being dispersed in the chamber which is created in the space comprised between the concave surface 6 and the lower part of the dispensing element 20. On the other hand, when the cap is closed, as can be observed in FIG. 4, the correct closed position is insured by stop 11. In correspondence with this position the indentation 30 of base 27 superimposes itself on the ring-shaped projection 8.

As can he seen, the cap according to the inventions fulfills the proposed purposes, since a cap has been obtained which, while it is easy to handle with a single hand, also offers, whether when closed or opened, a good tightness, so that in its opened position it allows the outpour of the liquid exclusively through the opening of the dispensing element, and in its closed position it operates as a complete seal both around the neck of the bottle and on the hole belonging to the cap itself and connected with the dispenser.

I claim:

1. A cap for liquids, made of plastic material, comprising:

a main essentially cylindrical body which tightens on a bottle or flagon, said main cylindrical body including an upper concave surface facing an exterior of the body, an opening formed in the concave surface, the opening being defined by a ring shaped projection at an upper peripheral edge thereof;

a dispensing element connected to said main cylindrical body for dispensing liquids, said dispensing element being rotatable around an axis which is perpendicular to the geometrical axis of said body and including a channel formed therein, said channel having a first section essentially vertically oriented with an opening formed in a distal base end thereof, and a second section perpendicularly oriented with respect to the first section with an opening formed in a distal end thereof, an upper flat round portion defining a lateral rim hinged onto an upper rim of the main body, and a lower part in the shape of a socle having a partially cylindrical base surface slidable on the corresponding concave surface of said main body; and a round sunken indentation found on the base surface of the lower part of the dispensing element surrounds the ring shaped projection of the opening formed in said main body in the closed position and, an inner periphery of the opening formed in the distal end of the first section receives said ring shaped projection in the dispensing position, thereby providing a fluid-tight seal between said dispensing element and said main cylindrical body.

2. The cap according to claim 1, wherein the opening formed in the concave surface of said main cylindrical body defines the ring-shaped projection entering into the opening of said first section of the dispensing element when in a dispensing position.

3. The cap according to claim 1, wherein the concave upper surface acquires an essentially semispherical shape on an inner surface thereof in contact with a neck of the bottle, thereby ensuring the fluid-tight seal.

4. The cap according to claim 1, wherein the upper concave surface includes two projections positioned on opposing sides of the opening formed in the concave surface for limiting movement of the lower part of said dispensing element in opened and closed positions of the cap, respectively.

* * * * *